US012146277B2

(12) United States Patent
Timmermann et al.

(10) Patent No.: US 12,146,277 B2
(45) Date of Patent: Nov. 19, 2024

(54) SYSTEM FOR MOVING A BARRIER WITH WARNING DEVICES THEREON

(71) Applicant: VMAG, LLC, San Antonio, TX (US)

(72) Inventors: Russell W Timmermann, New Braunfels, TX (US); Richard J Loos, San Antonio, TX (US)

( * ) Notice: Subject to any disclaimer, the term of this patent is extended or adjusted under 35 U.S.C. 154(b) by 480 days.

(21) Appl. No.: 17/505,436

(22) Filed: Oct. 19, 2021

(65) Prior Publication Data

US 2022/0120045 A1 Apr. 21, 2022

Related U.S. Application Data

(60) Provisional application No. 63/094,035, filed on Oct. 20, 2020.

(51) Int. Cl.
*E05F 11/54* (2006.01)
*E01F 13/04* (2006.01)
*E01F 13/06* (2006.01)

(52) U.S. Cl.
CPC ..... *E01F 13/048* (2013.01); *E01F 13/06* (2013.01)

(58) Field of Classification Search
CPC ..... E01F 13/048; E01F 13/06; E06B 11/045; E05Y 2201/434; E05Y 2900/70; E05F 15/60
USPC ..... 49/360
See application file for complete search history.

(56) References Cited

U.S. PATENT DOCUMENTS 1,739,714 A * 12/1929 Dolan ..... B61D 23/02 105/341
4,858,383 A * 8/1989 Kendig ..... E05F 15/641 49/362
5,220,746 A * 6/1993 Yeager ..... E01F 13/048 49/506
5,356,185 A * 10/1994 Cameron ..... E05B 65/0864 292/137
5,612,518 A * 3/1997 Jaminet ..... B66B 13/143 49/118
6,009,671 A * 1/2000 Sasaki ..... E05F 15/646 49/352

(Continued)

FOREIGN PATENT DOCUMENTS

JP 08105267 A * 4/1996
WO WO-2006040100 A1 * 4/2006 ..... E05D 15/0626

*Primary Examiner* — Jerry E Redman
(74) *Attorney, Agent, or Firm* — Gunn, Lee & Cave, P.C.; Nick Guinn

(57) ABSTRACT

A system for moving a barrier protecting a restricted area. A stationary linear induction motor moves the barrier by applying a magnetic field from the linear induction motor to a reaction fin attached to the barrier. The reaction fin has a groove on each side, which is engaged with guide members to guide the barrier. Holes are evenly spaced along the length of the reaction fin. Magnetic sensors sense the holes during movement of the barrier to determine the speed, position and direction of the barrier. Current flows in the reaction fin melt ice in cold weather environments. The system is operated by a main control logic that receives input data from the electronic sensors and controls the linear induction motor, heater and locking mechanism. An inductive connection charges a storage device mounted on the barrier, which storage device powers warning signals on the barrier.

9 Claims, 12 Drawing Sheets

(56) References Cited

U.S. PATENT DOCUMENTS

| | | | | | |
|---|---|---|---|---|---|
| 6,091,217 | A * | 7/2000 | Parsadayan | E05F 15/41 | 318/285 |
| 6,092,338 | A * | 7/2000 | Crowner | E05F 15/643 | 49/360 |
| 6,137,255 | A * | 10/2000 | Skalski | G05B 19/232 | 318/560 |
| 6,346,786 | B1 * | 2/2002 | Wood | E05F 15/60 | 318/135 |
| 6,507,160 | B2 * | 1/2003 | Wood | E05F 15/60 | 318/135 |
| 7,752,810 | B2 * | 7/2010 | Haab | E05D 15/063 | 49/404 |
| 8,020,346 | B2 * | 9/2011 | Singiser | E05D 15/0682 | 49/360 |
| 8,468,749 | B1 * | 6/2013 | Dufresne | E06B 11/045 | 49/404 |
| 2009/0189560 | A1 * | 7/2009 | Taheri | E05F 15/603 | 49/324 |
| 2010/0024307 | A1 * | 2/2010 | Dale | E06B 11/045 | 49/404 |
| 2011/0265382 | A1 * | 11/2011 | Timmermann | E05F 15/60 | 49/31 |
| 2013/0276489 | A1 * | 10/2013 | Timmermann | E05C 17/62 | 70/277 |
| 2022/0120045 | A1 * | 4/2022 | Timmermann | E01F 13/048 | |

* cited by examiner

SYSTEM FOR MOVING A BARRIER WITH WARNING DEVICES THEREON

CROSS REFERENCE TO RELATED APPLICATIONS

This is an improvement over Publicaton No. U.S. 2013/0276489, now abandoned.

BACKGROUND OF THE INVENTION

1. Field of the Invention

The present invention relates to gates and barriers to protect and control access to an enclosure or restricted area. More particularly, the present invention relates to opening and closing systems for barriers, doors, gates and related access control obstacles used to protect an area or enclosure, which have warning devices thereon. A control system operates all functions of the gate or barrier.

2. Description of the Related Art

Gates, doors, and barriers have long been used to control access to an enclosed area such as a building, room, warehouse, shed, or a marked-off, or restricted area. Several different systems have heretofore been used to selectively or automatically open and close such barriers to allow access to these areas by authorized personnel, while restricting access for unauthorized persons. Chain-drive or pinch wheel systems have typically been used to horizontally slide a barrier along a track to control such access. Such systems typically wrap a chain around a sprocket or pulley on a motor and connect the chain ends to the gate to slide the gate along a track. The pinch wheel systems utilize a flat bar or angle attached to the gate in such a way that two drive rollers can pinch the bar/angle between them with enough friction force to cause the bar to move when the rollers are turned by electric or hydraulic motors. However, these chain-drive systems involve several if not many moving parts which tend to wear and break. Moreover, the rotation of the chain can only occur at slow speeds to prevent the chain from jumping track. The result is a slowly moving barrier that is prone to mechanical wear.

Hydraulic cylinders have been used by attaching one end of the cylinder to the gate and another end of the cylinder to the motor to swing the gate when actuated by a control system. Like the chain-drive systems, the hydraulic systems typically open very slowly and contain many moving parts prone to breakage and weathering.

In addition to the above disadvantages, the prior opening and closing systems typically do not have a self-contained locking mechanism or rely on friction forces (which can easily be defected using lubricants) to lock the barrier and prevent unauthorized access by manual manipulation or other tampering. Instead, any locking mechanism is typically between the gate itself and the adjacent post. Such a locking method or mechanism exasperates the problem of breakage of these prior systems if the gate is mistakenly left locked during operation of the system Linear induction motors have been used in the past to open and close horizontally sliding gates or barriers, as is shown in U.S. Pat. Nos. 6,507,160 and 6,346,786. Typically a linear induction motor causes a reaction plate, which reaction plate is attached to a gate, to slide horizontally between opened and closed positions. A use of linear induction motors allows the acceleration/deceleration of the reaction plate and the gate attached thereto to be controlled to rapidly open or close a gate or barrier in a minimum amount of time.

SUMMARY OF THE INVENTION

The present invention provides an opening and closing system to open and close a barrier that moves the barrier faster than other systems and eliminates the moving mechanical drive and hydraulic components of other systems. The present system uses substantially no moving drive components in opening and closing the barrier. The present system also includes a self contained locking mechanism to lock the barrier in a fixed position.

The opening and closing system of the present invention is accomplished by use of a reaction fin attached to the barrier and is magnetically propelled by a linear induction motor. The reaction fin which has a general "T" shaped profile is made of multiple sections that are attached to each other with the overall length being dependent on the size of the opening to be controlled. Each plate substantially mirrors the other, and each plate has a flat top surface. The plates that comprise the reaction fin are attached to each other in a slightly offset manner wherein the end of one plate extends slightly beyond the other plate to form an overlap with attachment means.

There is a hollow, rectangular protrusion on each side of the reaction fin (i.e. on each plate) disposed a predefined distance below the top lips on the profile. The protrusions extend the length of the reaction fin on each side thereof, and receive guide members thereon. The guide members are disposed adjacently on the inner top surface of the linear induction motor housing on each side of the reaction fin and engage the respective protrusions on each side of the reaction fin. The protrusions and the guide members define a track during operation of the opening and closing system of the present invention.

The reaction fin is attached to the barrier using any suitable attachment device. In one embodiment, the reaction fin is attached to the barrier by triangular attachment brackets attached to the top surface of the reaction fin The bracket is substantially "L" shaped and has a triangular reinforcing plate extending across the outer surface of the legs that form the "L" shape of the bracket.

The linear induction motor is connected to a power source and has electromagnetic coils disposed in close proximity to the reaction fin on each side thereof. The linear induction motor is driven by a motor driver electronic control. The linear induction motor imparts an electric current in the coils when activated by the electronic control. The coils induce electric currents in the reaction fin which in turn produces a magnetic field in the reaction fin, thereby propelling the reaction fin along the track.

There are a plurality of apertures or holes along the bottom of the reaction fin which are parallel to the protrusions. The holes extend the length of the reaction fin and extend through the reaction fin. The holes are substantially equally dimensioned (i.e. having substantially the same size and shape) and are spaced along the length of the reaction fin in substantially equal intervals. This series of holes produces a position, speed and direction value for reading by sensors, as will be discussed later.

A locking mechanism is designed to engage any one of the holes in the reaction fin to lock the barrier in a fixed location. The locking mechanism is adjacent the linear induction motor in one embodiment and has a pin that pivots to engage/disengage any one of the holes in the reaction fin.

Therefore, the locking mechanism should be located in close proximity to the holes of the reaction fin. It should be understood that the locking mechanism can be located anywhere along the length of the reaction fin so long as it is located in a position close enough to engage the holes of the reaction fin.

The pin of the locking mechanism comprises a flat vertical plate attached at its upper end to a lever engagement member within a locking mechanism housing. The lower outer end of the pin opposite the attachment site to the lever engagement member terminates in a cylindrical knob that engages one of the holes of the reaction fin to lock the barrier in a fixed location. The pin is disposed between and pivotally attached to two vertical plates within the housing. The two vertical plates are perpendicularly attached to a panel. The vertical plates and the panel define the housing for the pin A manual operation lever extends through the panel of the housing and is exposed to the ambient environment on one end. The lever is pivotally attached to the two vertical plates of the housing. The lever terminates on the end within the housing in a substantially "L" shaped arm defining a slot. The arm of the lever is adjacent and engaged with the lever engagement member. The lever engagement member is retractable and extendable within a control housing. A coil is disposed adjacent the lever engagement member to extend or retract the lever engagement member. A spring is attached to the pin above the knob of the pin, and also to a rod extending between and attached to the two vertical plates of the housing. The spring assists the gravity return of the lock pin to the locked position when the lock electric control is deenergized.

In operation, an electric control is used to activate the coil. The coil extends the lever engagement member. The slot of the lever is designed to receive a portion of the lever engagement member as it descends. The lever engagement member pulls the pin upward, causing the pin to rotate along its rotational axis and retreat the knob of the pin into the pin housing which disengages a hole in the reaction fin. The lever can be operated manually, or electronically via a main control logic, as discussed below.

Two electronic sensors are disposed outside of the locking mechanism housing. The sensors are disposed on each side of the housing in one embodiment. However, the sensors could be disposed anywhere in the system so long as the sensors are in close proximity to the holes of the reaction fin. The sensors are aligned substantially in the same plane as the holes of the reaction fin. The sensors are designed to sense the motion of the reaction fin during movement by measuring reaction fin material between adjacent holes as they pass across the sensors. The sensors and associated electronic controls also determine the position and the location of the reaction fin by counting each successive hole in the reaction fin.

In one embodiment of the present invention, a heating device is provided within the hollow of the rectangular protrusion on each side of the reaction fin. The heating device is preferably a resistance heating wire. However, other heating devices may be used. The heating wire is disposed within the rectangular beams of the reaction fin, and runs the length of the rectangular beams. The heating wire is inductively coupled to a power source with no exposed electrical connections, and when activated, causes a current within the heating element inside rectangular protrusions of the reaction fin, thereby heating the reaction fin above the freezing point of water. The purpose of the heating wire is to melt ice or snow that may form on the reaction fin. The accumulation of ice and snow on the reaction fin in cold weather environments could cause the system to jam, which would prevent the barrier from moving.

The system of the present invention is controlled by an electronic control panel. System control software is loaded into the main logic controller. The main logic controller executes the software associated with the system to control the various parts of the system. The main logic control software to control the motor driver electronic control to energize the linear induction motor(s) to move the barrier. Similarly, sensor software is executed by the main logic controller to send and receive information from the sensors to determine the speed, direction and location of the reaction fin.

Lock control software is executed by the main logic controller to control the lock driver electronic control, which activates the locking mechanism when desired to lock or unlock the barrier by rotating the pin to either engage or disengage the pin from one of the holes of the reaction fin. Heater control software is executed by the main logic controller. The main logic controller operates the heater control software to control the heater driver electronic control to turn the heating device on or off In an alternative gate operator controller, a programmable logic controller is provided that has a main logic control with inputs and outputs. A user interface display connects to the main logic control. Signals from electronic position sensors feed through electronic position sensors software to the main logic control, which indicates the position of the barrier or gate. The device inputs through device input software to the main logic control controls the outputs.

When the gate or barrier is closed, a closed limit output activates an inductive transmitter. The inductive transmitter is positioned adjacent to an inductive receiver mounted on the gate. The inductive receiver charges an ultra capacitor bank located on the gate. The ultra capacitor bank then can control the electronic devices mounted on the gate, such as multiple LED light arrays activated through an LED controller.

Depending upon the position of the gate or barrier as determined by electronic position sensors fed to the main logic controller through electronic position sensor software, logic control software may be activated through a lock driver controller to activate the lock mechanism.

The main logic controller through motor control software activates a variable frequency drive to active a primary and secondary linear induction motor to control horizontal movement of the gate or barrier.

From the main logic control through drive status software connecting through a variable frequency drive, a feedback through drive healthy software determines if the system is operating properly. By holding the gate or barrier in position through heater controlled software, inductive currents are created to cause current to flow through the reaction fin. During cold weather the inductive currents can melt any snow or ice to prevent jamming. An encoder feeding to the variable frequency drive ensures the primary and secondary linear induction motors move the gate or barrier in the proper speed and direction while controlling acceleration and deceleration.

DESCRIPTION OF THE INVENTION

Figure 1:
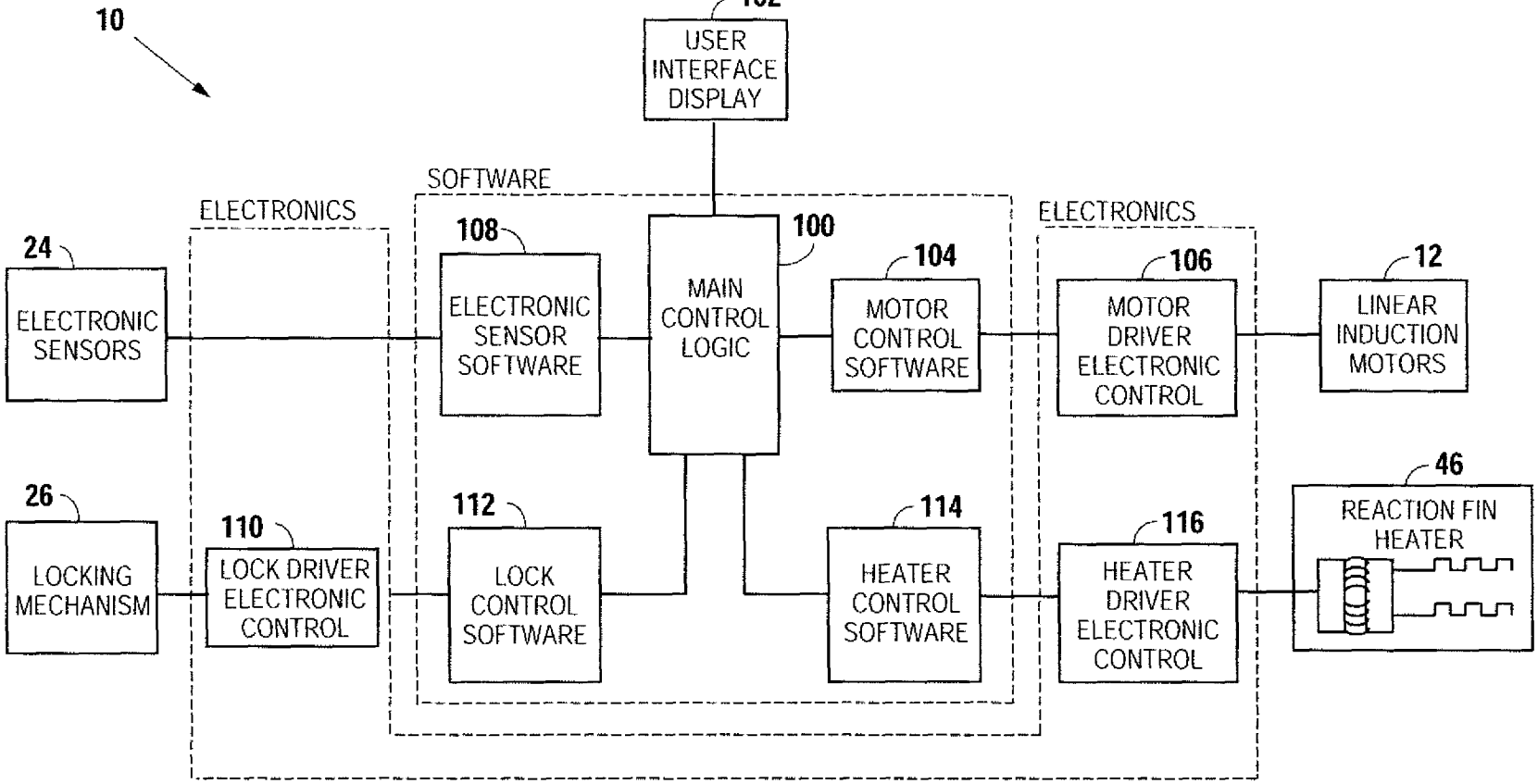
FIG. 1 is a block diagram showing the control and operation of the system of the present invention.

Referring to FIGS. 1, 7, 8 and 9, the system 10 of the present invention is disclosed. The system 10 is operated by at least one linear induction motor 12. However, it should be understood that more than one linear induction motor 12 can be implemented into the system 10. This is especially advantageous where a barrier 16 is particularly heavy, or where barrier 16 has a long distance to travel to block an entryway (not shown).

Referring to FIGS. 4 through 9, a reaction fin 14 is attached to barrier 16. Reaction fin 14 is comprised of a first plate 14*a* attached to a second plate 14*b*. First plate 14*a* is slightly offset from second plate 14*b* such that first plate 14*a* extends longitudinally slightly beyond second plate 14*b* on one end of reaction fin 14. On the opposite end of reaction fin 14, second plate 14*b* extends longitudinally slightly beyond first plate 14*a*. Other than the slight offset, plates 14*a* and 14*b* substantially mirror one another and are attached to each other along flat sides (not shown) of plates 14*a* and 14*b*.

Figure 4:
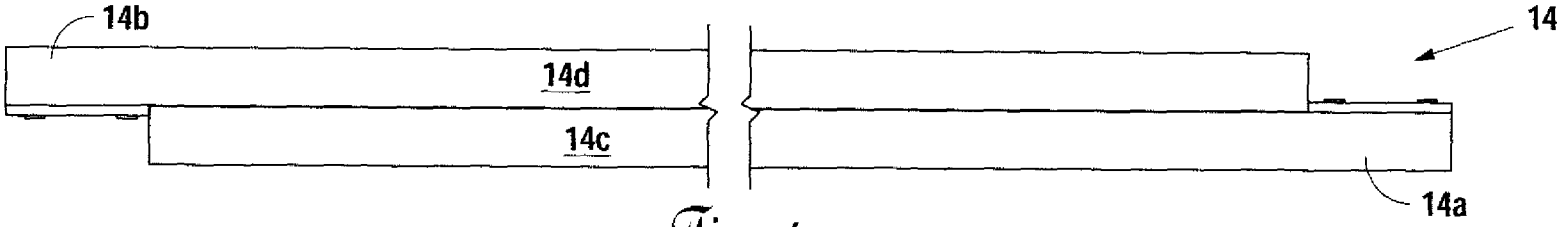
FIG. 4 is a top view of the reaction fin of the present invention.
Figure 5:
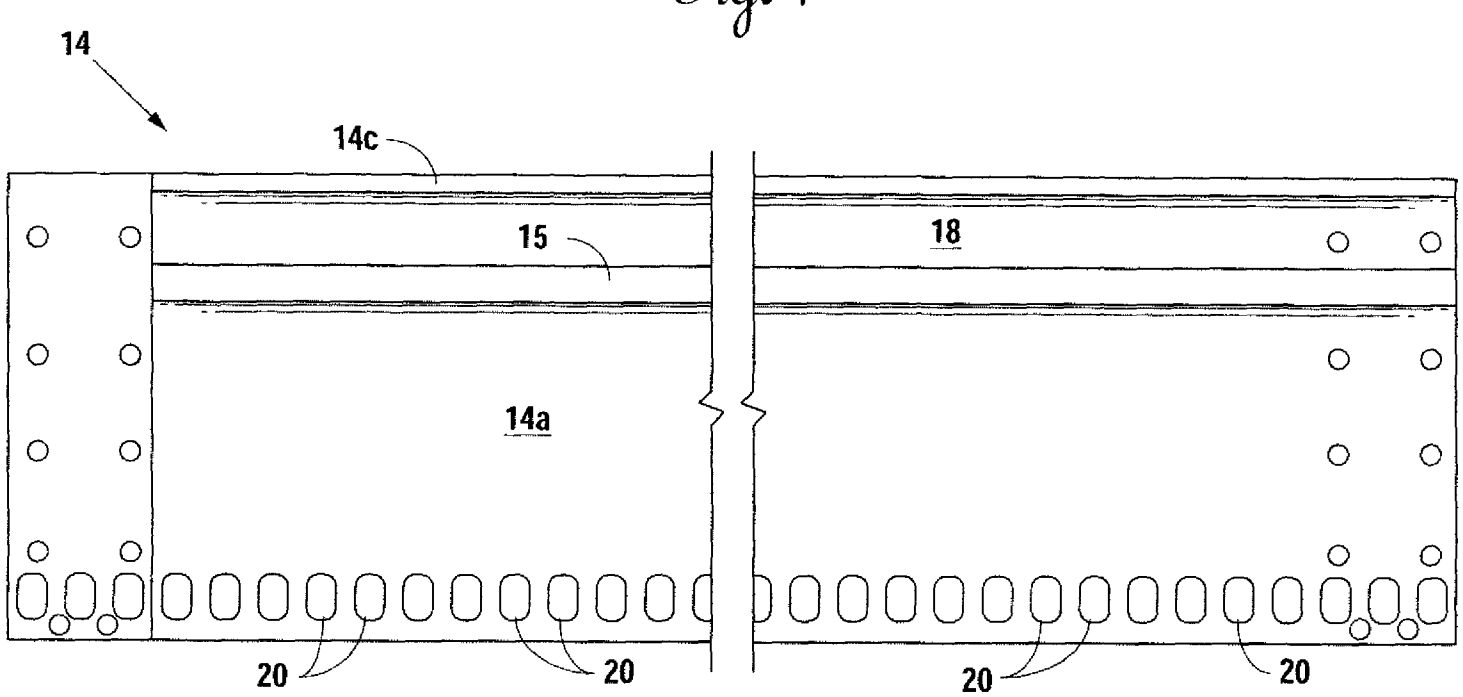
FIG. 5 is a front view of the reaction fin of the present invention.
Figure 6:
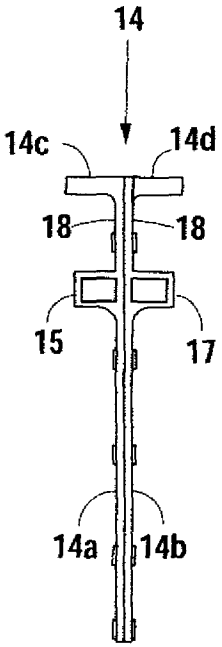
FIG. 6 is a side view of the reaction fin of the present invention;.

Referring to FIGS. 4, 5 and 6, each of the plates 14*a* and 14*b* of reaction fin 14 terminate on their upper portions in flat, substantially horizontal lips 14*c* and 14*d*, respectively. Lips 14*c* and 14*d* extend the length of reaction fin 14. Rectangular beam or protrusion 15 of first plate 14*a* and rectangular beam or protrusion 17 of second plate 14*b* are disposed a predefined distance below lips 14*c* and 14*d*, respectively. Rectangular beams or protrusion 15 and/or protrusion 17 are substantially parallel to lips 14*c* and 14*d*, respectively, and extend the length of reaction fin 14. Lip 14*c* and rectangular beam or protrusion 15 of first plate 14*a* define a groove 18. Lip 14*d* and rectangular beam or protrusion 17 of second plate 14*b* also define a groove 18.

The space between protrusion 15 and lip 14*c*, as well as between protrusion 17 and lip 14*d* forms the grooves 18. Inside of the grooves 18, and riding on the protrusions 15 and 17 are guide members 19 (see FIG. 7). Guide member 19 on protrusions 15 and 17 allow the linear induction motor 12 to easily move along the reaction fin 14.

A plurality of apertures or holes 20 extend through first plate 14*a* and second plate 14*b* and are disposed below grooves 18. Holes 20 are shown on the lower longitudinal end of reaction fin 14 opposite grooves 18. However, holes 20 could be placed anywhere on reaction fin 14 below grooves 18. Holes 20 extend the length of reaction fin 14, and are substantially identically sized and shaped. Holes 20 are spaced at a predetermined interval from each other such that each hole 20 is substantially equally spaced from adjacent holes 20.

Figure 7:
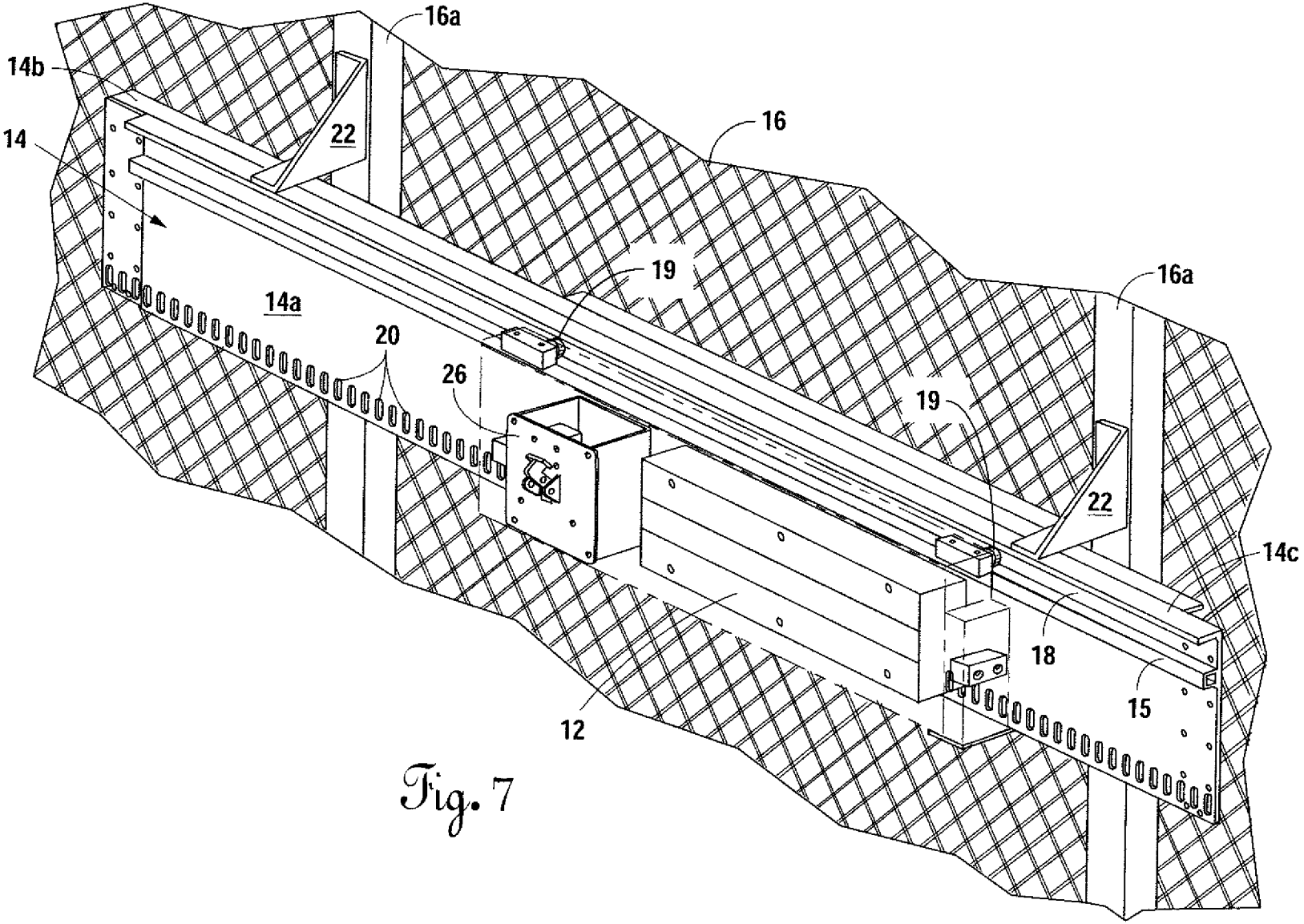
FIG. 7 is a perspective view of the system of the present invention in conjunction with a barrier, but with the housing of the linear induction motor being shown in broken lines.
Figure 8:
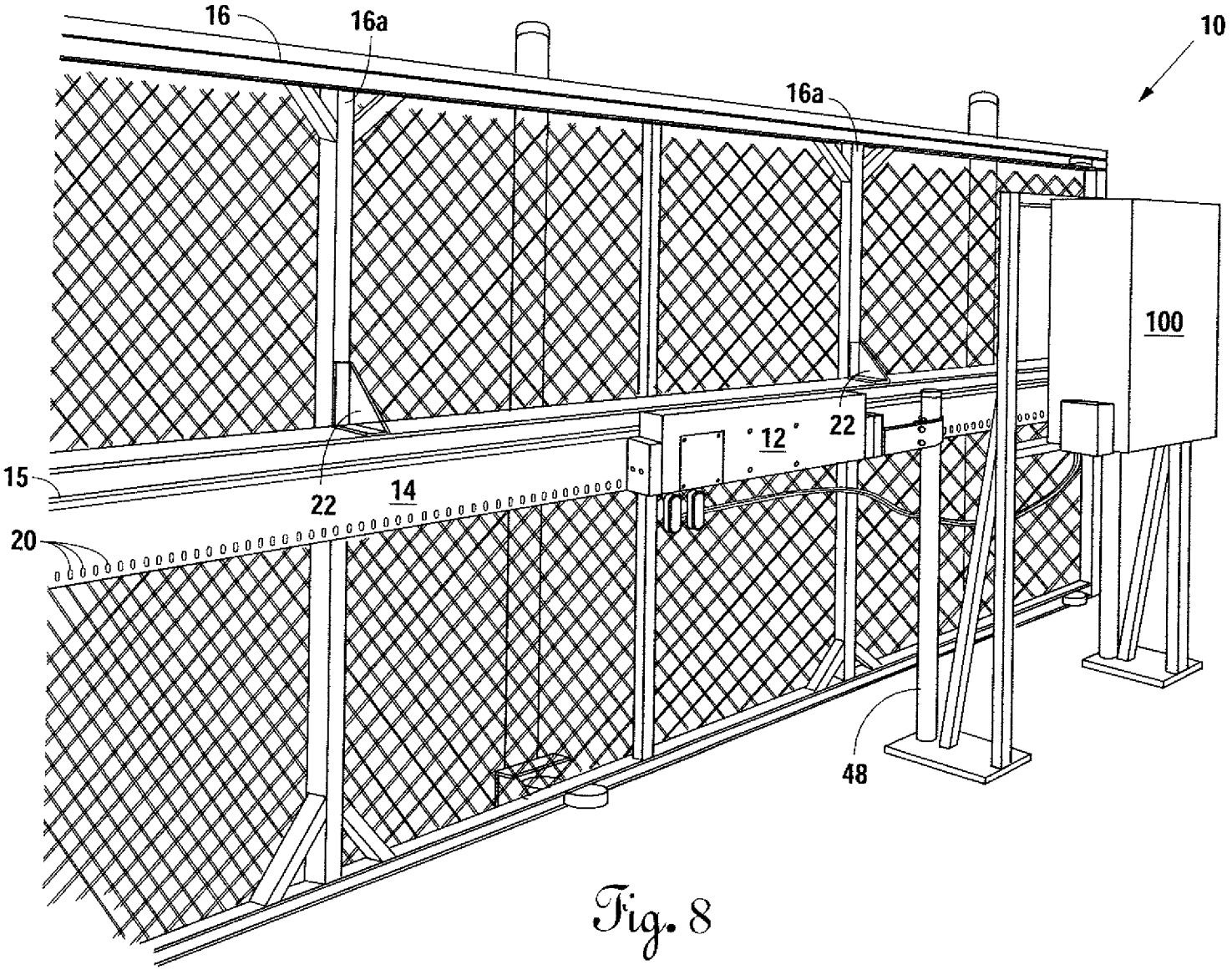
FIG. 8 is a perspective view of the system of the present invention in conjunction with a barrier.
Figure 9:
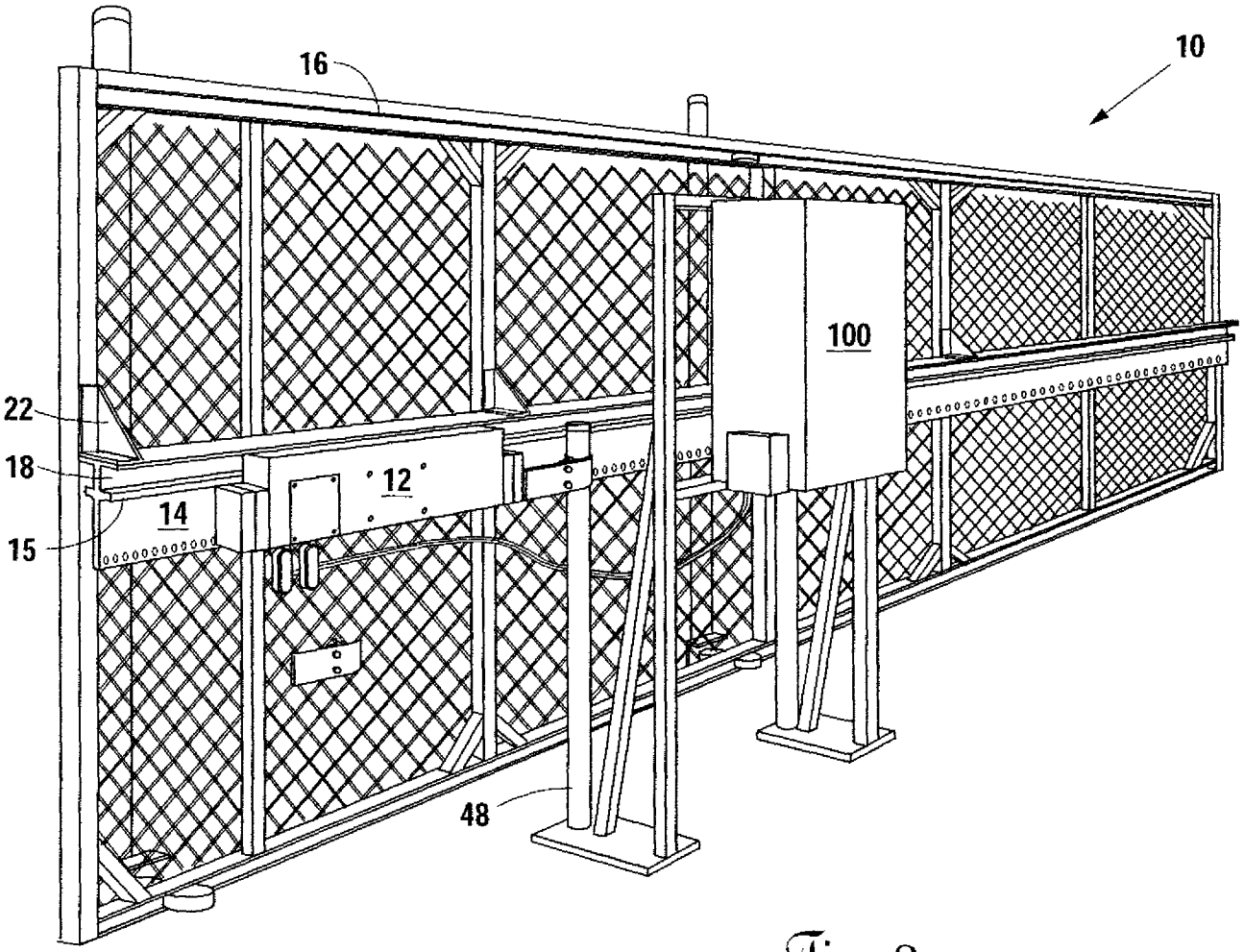
FIG. 9 is a perspective view of the system of the present invention in conjunction with a barrier.

Referring to FIGS. 7 through 9, reaction fin 14 is shown as being attached to barrier 16 by a plurality of brackets 22. Brackets 22 are generally triangular shaped, having legs attached to lips 14*c* and 14*d* of reaction fin 14. Vertical legs of brackets 22 are attached to posts 16*a* of barrier 16. There is a triangular reinforcement plate attached to the two legs of bracket 22. The attachment of reaction fin 14 to barrier 16 using brackets 22 can be secured by screws or any other suitable attaching mechanism. Moreover, brackets 22 can be welded to posts 16*a* of barrier 16. Reaction fin 14 is preferably made of an aluminum alloy. However, other metals such as steel, copper or iron can be used.

Figure 2:
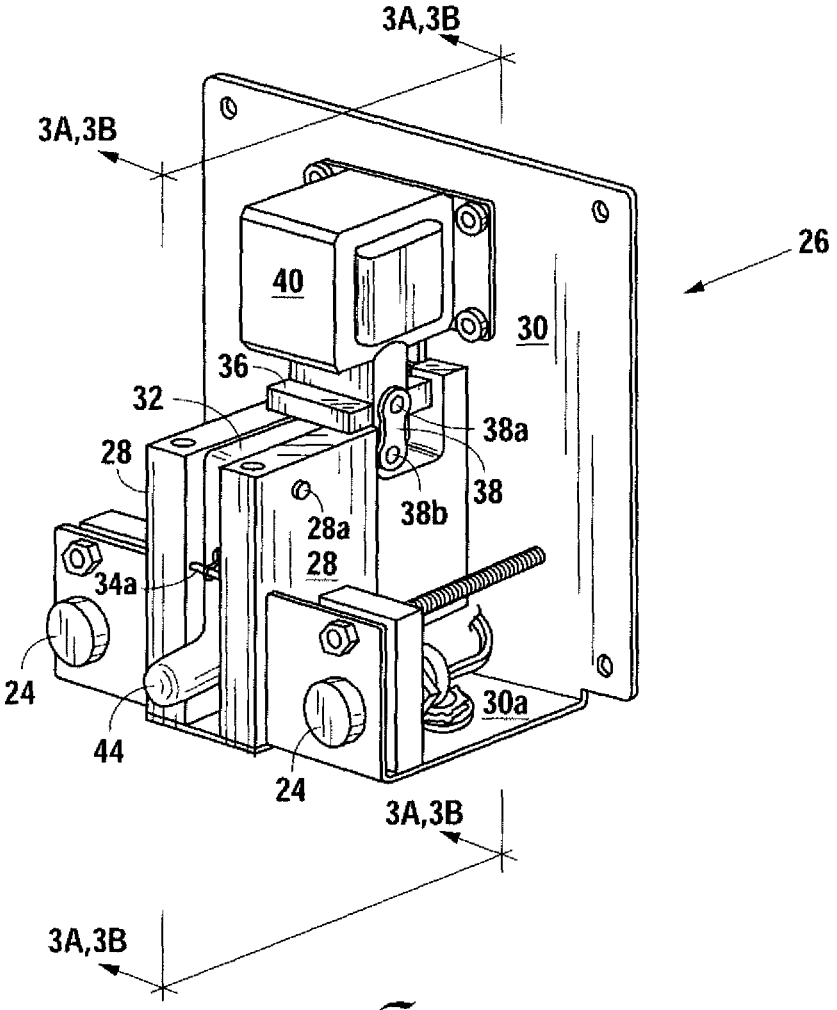
FIG. 2 is a perspective view of the locking mechanism including the housing and the magnetic sensors.
Figure 3A:
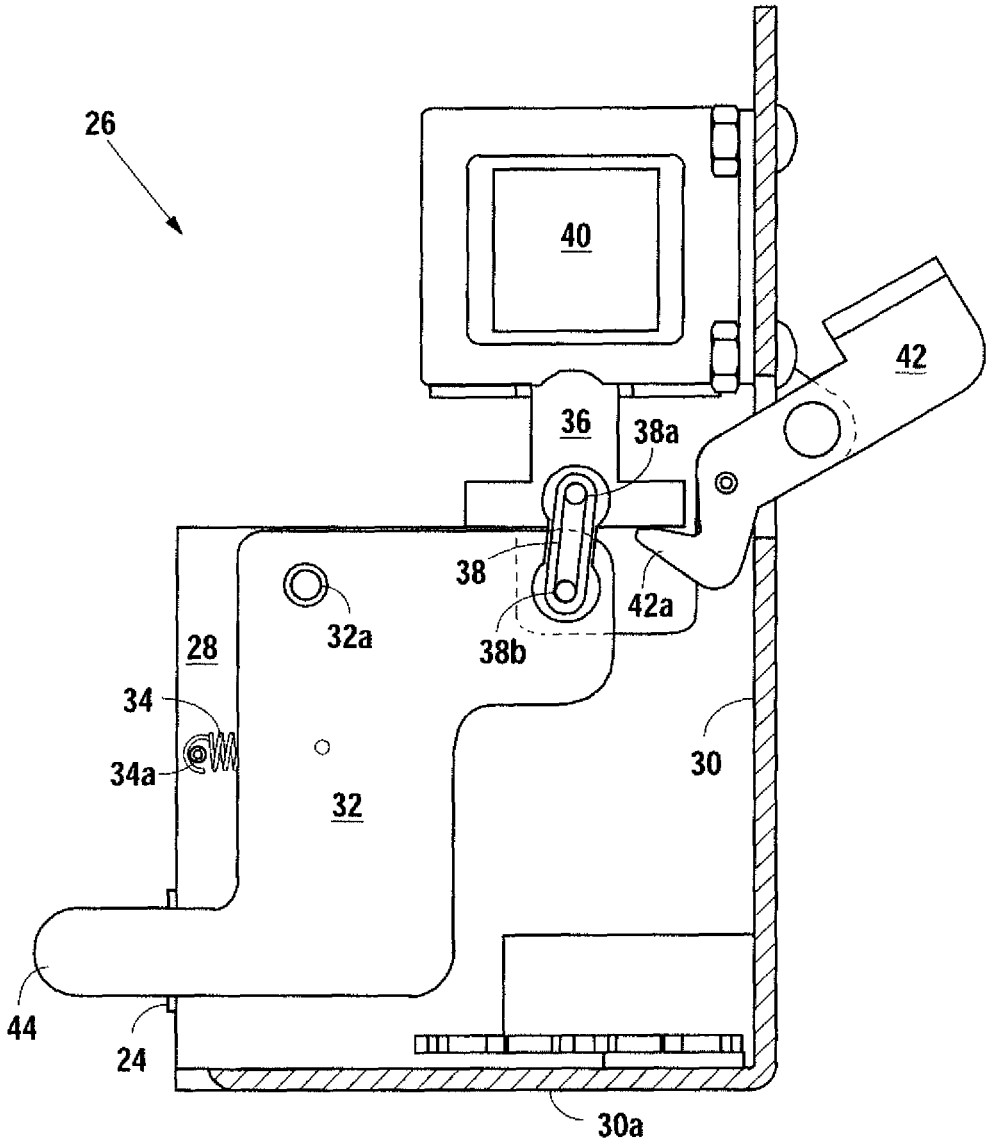
FIG. 3A is a sectional side view of the locking mechanism of the present invention along line 3A-3A of FIG. 2 showing the locking mechanism in an engaged position.
Figure 3B:
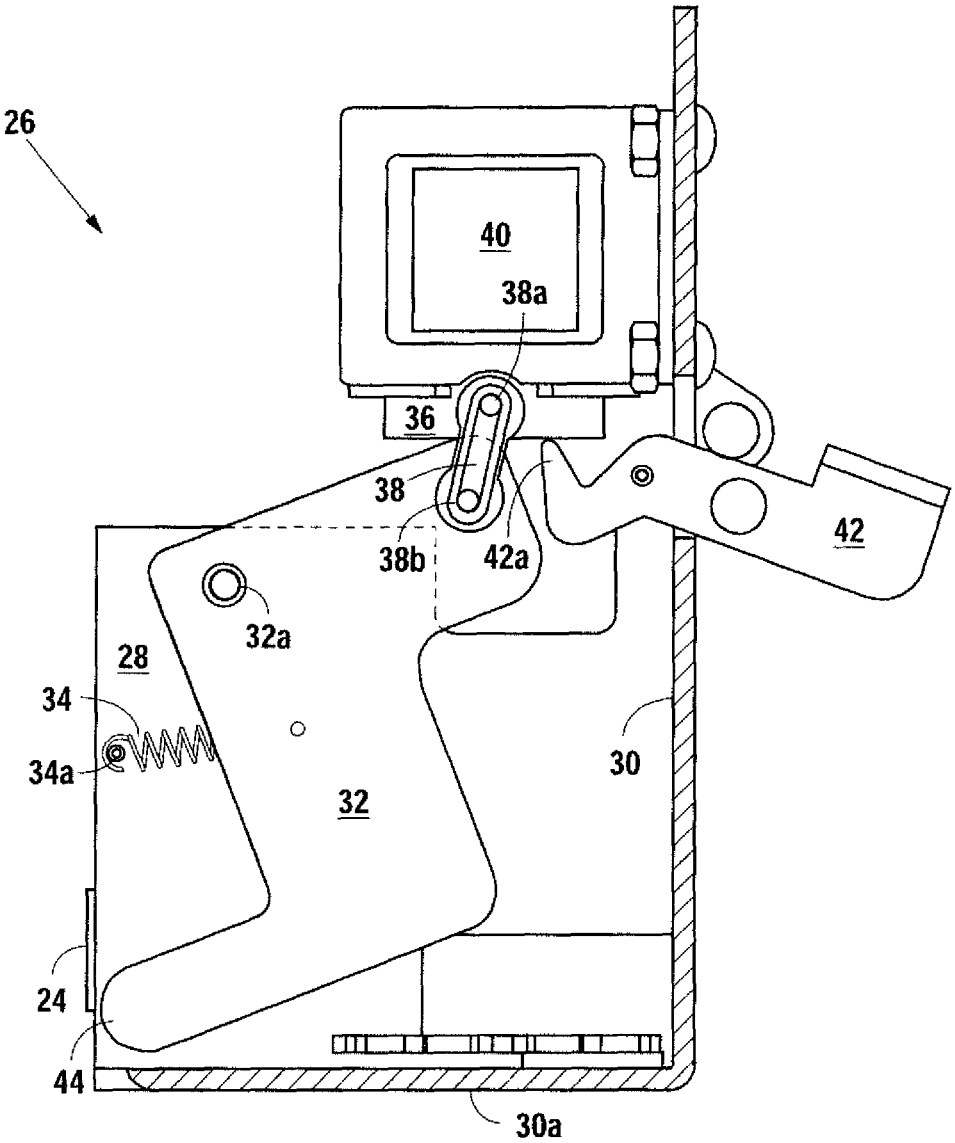
FIG. 3B is a sectional side view of the locking mechanism of the present invention along line 3B-3B of FIG. 2 showing the locking mechanism in a disengaged position.

Referring to FIGS. 2, 3A and 3B, electronic sensors 24 and locking mechanism 26 of the system 10 are shown. FIG. 3A shows locking mechanism 26 in an engaged position with pin 44 extending outside locking mechanism 26 to engage one of the holes 20 of reaction fin 14. FIG. 3B shows locking mechanism 26 in a disengaged position with pin 44 residing within locking mechanism 26. Locking mechanism 26 has two vertical plates 28, which are perpendicularly attached to a panel 30 along the back ends of vertical plates 28. Panel 30 forms a base 30*a* on which locking mechanism 26 rests. A pin mechanism 32 is disposed between vertical plates 28 and pivotally attached thereto. Pin mechanism 32 has a wide vertical portion, an upper horizontal portion, and a lower horizontal portion. Pin mechanism 32 has a hole 32*a* through which a bolt or other appropriate pivot is inserted. Hole 32*a* is disposed on the upper portion of pin mechanism 32. Corresponding holes 28*a* are disposed through vertical plates 28. A bolt, pin, or other pivot (not shown) is inserted through holes 28*a* and 32*a* to pivotally attach pin mechanism 32 to vertical plates 28.

A spring 34 is attached on one end to a rod 34*a* disposed between and connected to vertical plates 28. On its other end, spring 34 is attached to pin mechanism 32 below hole 32*a*. Spring 34 is loaded such that pin mechanism 32 will be biased to an engaged position by spring 34.

Pin mechanism 32 is connected to a lever engagement member 36. As shown, pin mechanism 32 is connected to lever engagement member 36 via a link plate mechanism 38 with a first pin 38*a* disposed through link plate 38 into lever engagement member 36, and a second pin 38*b* disposed through link plate 38 into pin mechanism 32. However, any other suitable attaching mechanism can be used. Lever engagement member 36 has a flat bottom surface that engages pin mechanism 32, and is extendable and retractable within a coil housing 40. A coil (not shown) extends and retracts lever engagement member 36 when activated.

A lever 42 is pivotally attached to and between vertical plates 28 inside of panel 30 and opposite the pivotal attachment of pin mechanism 32 to vertical plates 28. Lever 42 extends within vertical plates 28, and terminates in an arm 42*a* extending outward from Lever 42. Arm 42*a* defines a rectangular beam and provides a surface for receiving an end portion of lever engagement mechanism 36.

FIG. 3A shows the locking mechanism 26 in the locked position, which is also when no electric current is being applied to the coil in coil housing 40. The locking mechanism 26 can be manually opened by pushing down on lever 42. By applying current to the coil, lever engagement member 36 is pulled upward, thereby pulling the link plate 38 and pin mechanism 32 upward. The pin mechanism 32 pivots around hole 32*a* and the pivot pin contained therein. This pivoting motion extracts pin 44 from a locked position to the unlocked position as shown in FIG. 3B.

Referring to FIG. 2, two electronic sensors 24 are disposed adjacent locking mechanism 26. Vertical plates 28 and pin mechanism are disposed between electronic sensors 24. However, it is not critical that electronic sensors 24 be situated on each side of the locking mechanism 26. Electronic sensors 24 can be situated at any position in the system 10 that allow electronic sensors 24 to sense holes 20 as reaction fin 14 passes by electronic sensors 24 during operation of the system 10. Electronic sensors 24 can be any magnetic sensor known in the art capable of determining speed, position and linear direction. Electronic sensors 24 are disposed in close proximity to reaction fin 14 at an appropriate position to sense holes 20 of reaction fin 14 as reaction fin 14 moves past electronic sensors 24. Electronic sensors 24 measure the speed of movement of the reaction fin 14 by sensing the time interval between the passage of successive holes 20 across electronic sensors 24.

Referring to FIGS. 7 through 9, the linear induction motor 12 is located in close proximity to reaction fin 14. Linear induction motor 12 is arranged adjacent the reaction fin 14 such that reaction fin 14 is received within linear induction motor 12. Linear induction motor 12 can have two portions, one on each side of reaction fin 14, or one linear induction motor can be substituted with an equally shaped piece of ferrous metal of same thickness, and specifically in close proximity to first plate 14*a* and second plate 14*b*.

Guide members 19 can be rollers riding on the top of protrusion 15, which guide members 19 are contained within groove 18. Additional guide members 19 (not shown in FIG. 7) may be on the other side of reaction fin 14.

A plurality of electromagnetic coils (not shown) are disposed within linear induction motor 12 in close proximity with reaction fin 14. While reaction fin 14 and barrier 16 can move linearly, the linear induction motor 12 is rigidly attached to a stationary object in close proximity of linear induction motor 12, which holds linear induction motor 12 in position. During such movement, guide member 19 maintains the electromagnetic coil in a properly spaced relationship with the reaction fin 14 while also allowing ease of such movement. As shown in FIGS. 8 and 9, linear induction motor 12 is attached to a pole 48. However, linear induction motor 12 could be attached to any suitable stationary object in close proximity to linear induction motor 12.

Figure 10A:
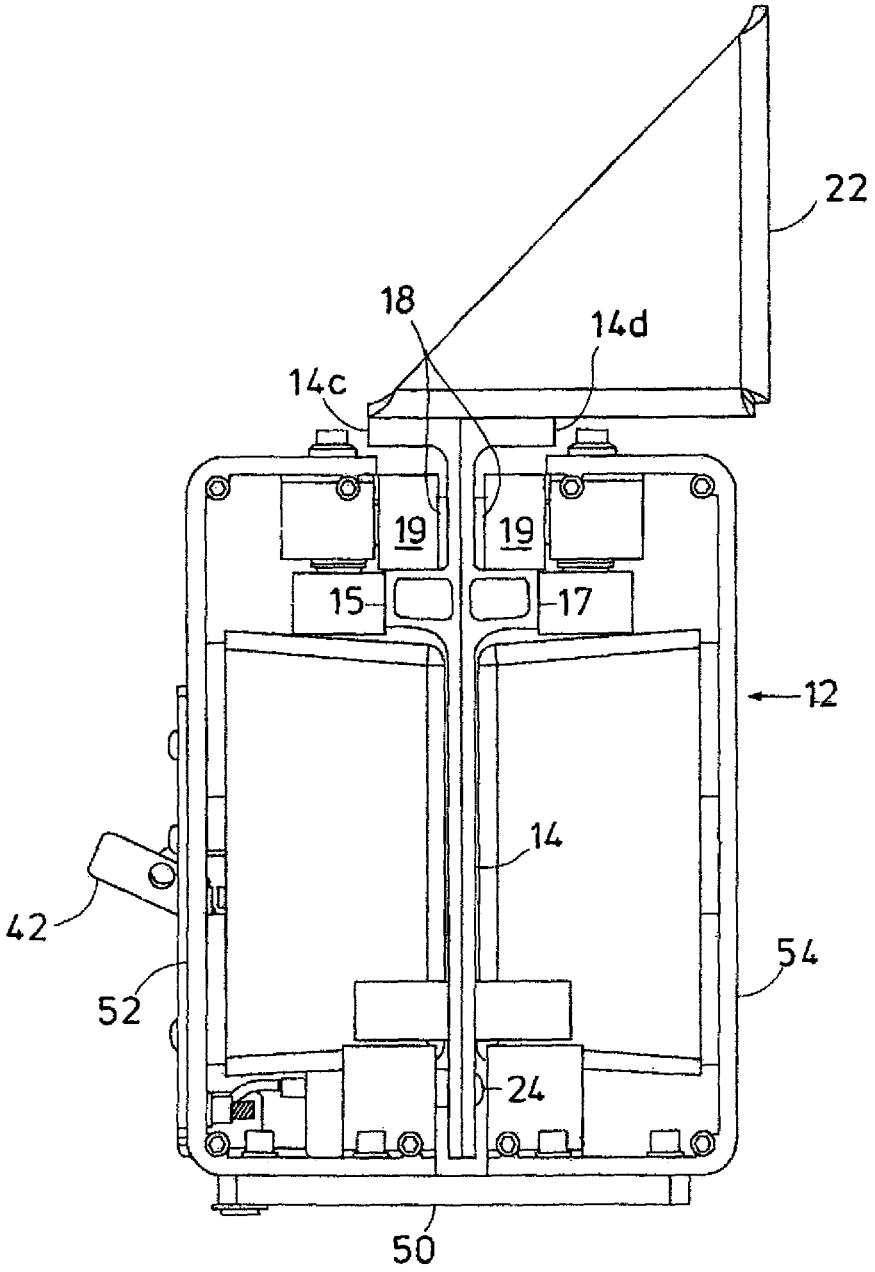
FIG. 10*a* is a right end view of the linear induction motor with parts cut away to illustrate positioning of the guide members.
Figure 10B:
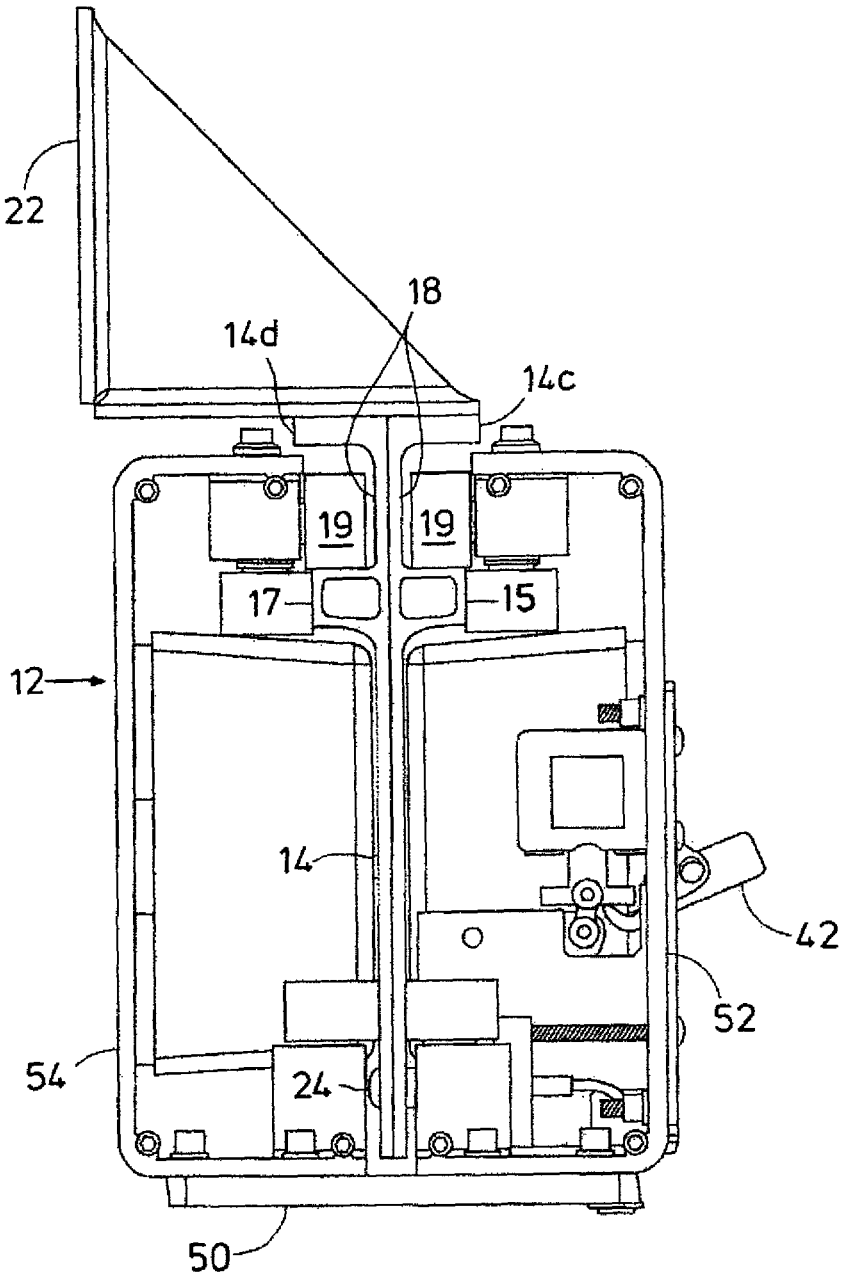
FIG. 10*b* is a left end view of the linear induction motor with parts cut away to illustrate positioning of the guide members.

FIGS. 10*a* and *b* show the linear induction motor 12 of the present invention, but with portions removed to illustrate the position of the guide members 19 on top of protrusions 15 and 17. The guide members 19 are contained within grooves 18 formed between protrusions 15 and 17 and lips 14*c* and 14*d*, respectively.

In FIGS. 10*a* and *b*, the barrier 16 (not shown) would be attached to brackets 22, which brackets 22 also connect to lips 14*c* and 14*d* of reaction fin 14. Lower plate 50 attaches the left housing 52 to the right housing 54 for the linear induction motor 12 to keep everything securely mounted on the reaction fin 14. The lever 42 and pin 44 of the locking mechanism 26 (not shown) can be seen in the background.

Linear induction motor 12 is connected to a power source (not shown). When activated, linear induction motor 12 imparts motion on reaction fin 14 by sending an electrical current (not shown) to electromagnetic coils (not shown). The coils induce electric current in the reaction fin 14, which in turn produces magnetic fields about the reaction fin 14, thereby causing propulsion of reaction fin 14. To propel reaction fin 14 in the opposite direction, the electric rotation of the magnetic field produced by the coils is reversed.

Referring to FIGS. 1 and 7 through 9, the system 10 of the present invention is operated by a main control logic 100. Main control logic 100 connects to a user interface display 102, allowing a person to observe, set, or alter parameters of the system 10 established and recorded on main control logic 100. Main control logic 100 operates motor control software 104 to control motor driver electronic control 106. Motor driver electronic control 106 controls the operation of linear induction motors 12.

Initially, a travel distance (not shown) is calculated to determine the distance barrier 16 must travel to achieve a completely closed position and a completely open position. This calculation may be done manually, and input into main control logic 100 via user interface display 102. Alternatively, an initial operation of the system 10 can establish such parameters by main control logic 100 receiving the positions of barrier 16 in open and closed position from electronic sensors 24.

Once the travel distance is determined and input into main control logic 100, parameters for starting, accelerating, decelerating and stopping the system 10 are established and input into main control logic 100. Parameters for starting, accelerating, decelerating and stopping the system 10 may be established and input into main control logic 100 either manually through user interface display 102, or by motor control software 104.

Main control logic 100 operates electronic sensor software 108. Electronic sensor software 108 communicates with electronic sensors 24, receiving input data from sensors 24 to establish the speed, position and direction of reaction fin 14. Main control logic 100 receives the input data from electronic sensors 24 and sends appropriate command signals (not shown) to motor driver electronic control 106 to start, accelerate, decelerate, stop or reverse the system 10 by varying linear induction motor 12 output to appropriately adjust the magnetic field imposed on reaction fin 14 in response to the command signal (not shown).

Lock control software 112 is operated by main control logic 100, and communicates with a lock driver electronic control 110 to activate locking mechanism 26 to lock and unlock barrier 16. Main control logic 100 sends an activation command (not shown) to lock driver electronic control 110, which activates the coil (not shown) of locking mechanism 26 to engage/disengage pin 44 to/from one of the holes 20 of reaction fin 14, as described herein above.

Optionally, a reaction fin heater 46 can be installed on reaction fin 14. Reaction fin heater 46 is provided within each of rectangular beams or protrusions 15 and 17 of reaction fin 14. Reaction fin heater 46 is preferably a resistance heating wire. However, other heating devices may be used. Reaction fin heater 46 is disposed within rectangular beams or protrusions 15 and 17 of reaction fin 14, and runs the length of rectangular beams 15 and 17. Reaction fin heater 46 is connected to a power source (not shown), and when activated, emits a current on the reaction fin heater 46, thereby heating reaction fin 14 above the freezing point of water. Reaction fin heater 46 is particularly advantageous in cold weather environments where ice and/or snow can accumulate within grooves 18 of reaction fin 14, causing the system 10 to jam, thereby preventing barrier 16 from opening or closing. Reaction fin heater 46 heats reaction fin 14 to cause the ice/snow forming on reaction fin 14 to melt.

Main control logic 100 operates heater control software 114, which communicates with a heater driver electronic control 116. Heater driver electronic control activates and/or deactivates the current flow through reaction fin heater 46 in response to a command (not shown) from main control logic 100.

Figure 11A:
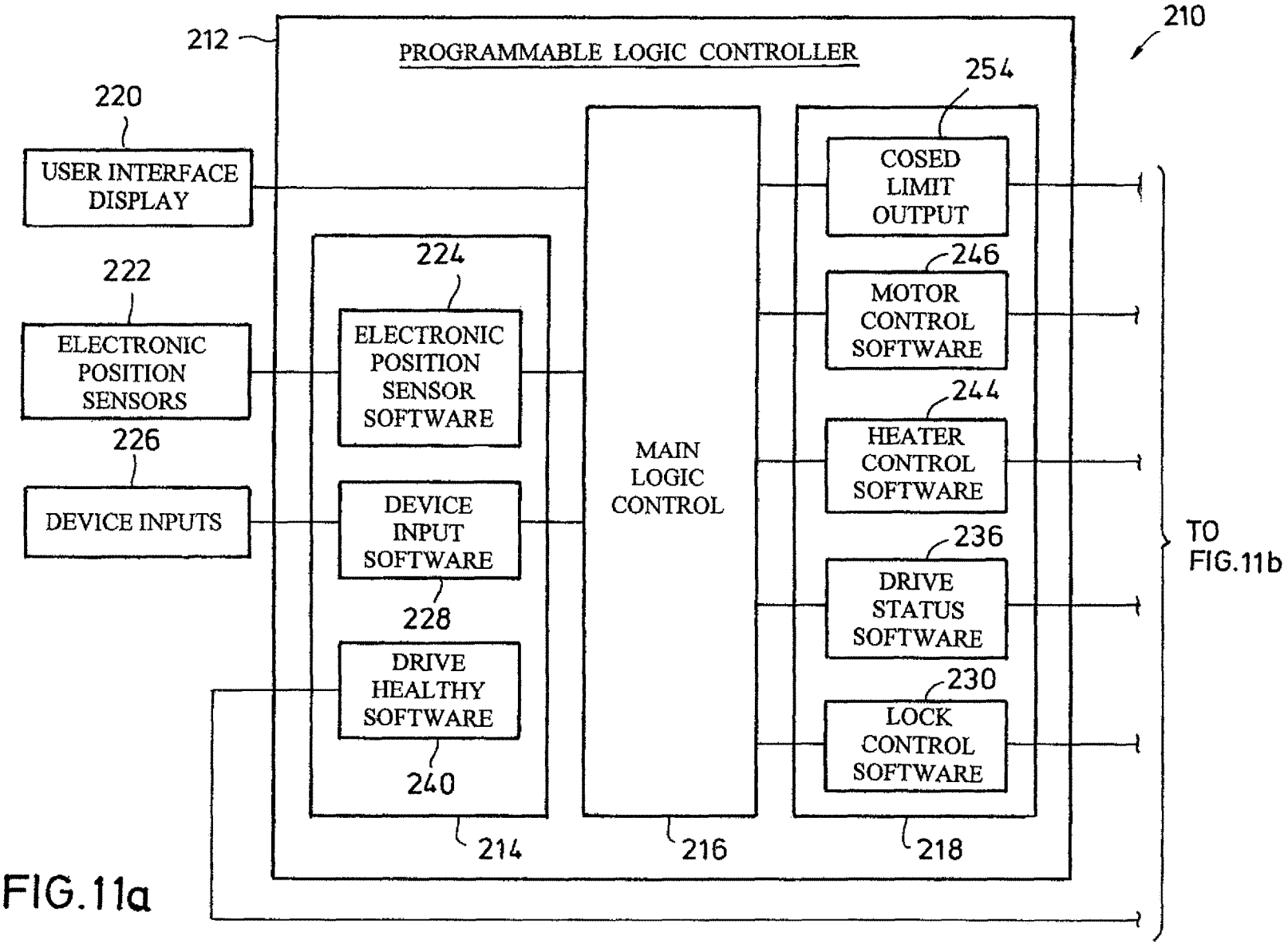
FIGS. 11*a* and 11*b* are a block diagram showing an alternative method of control and operation of the system.
Figure 11B:
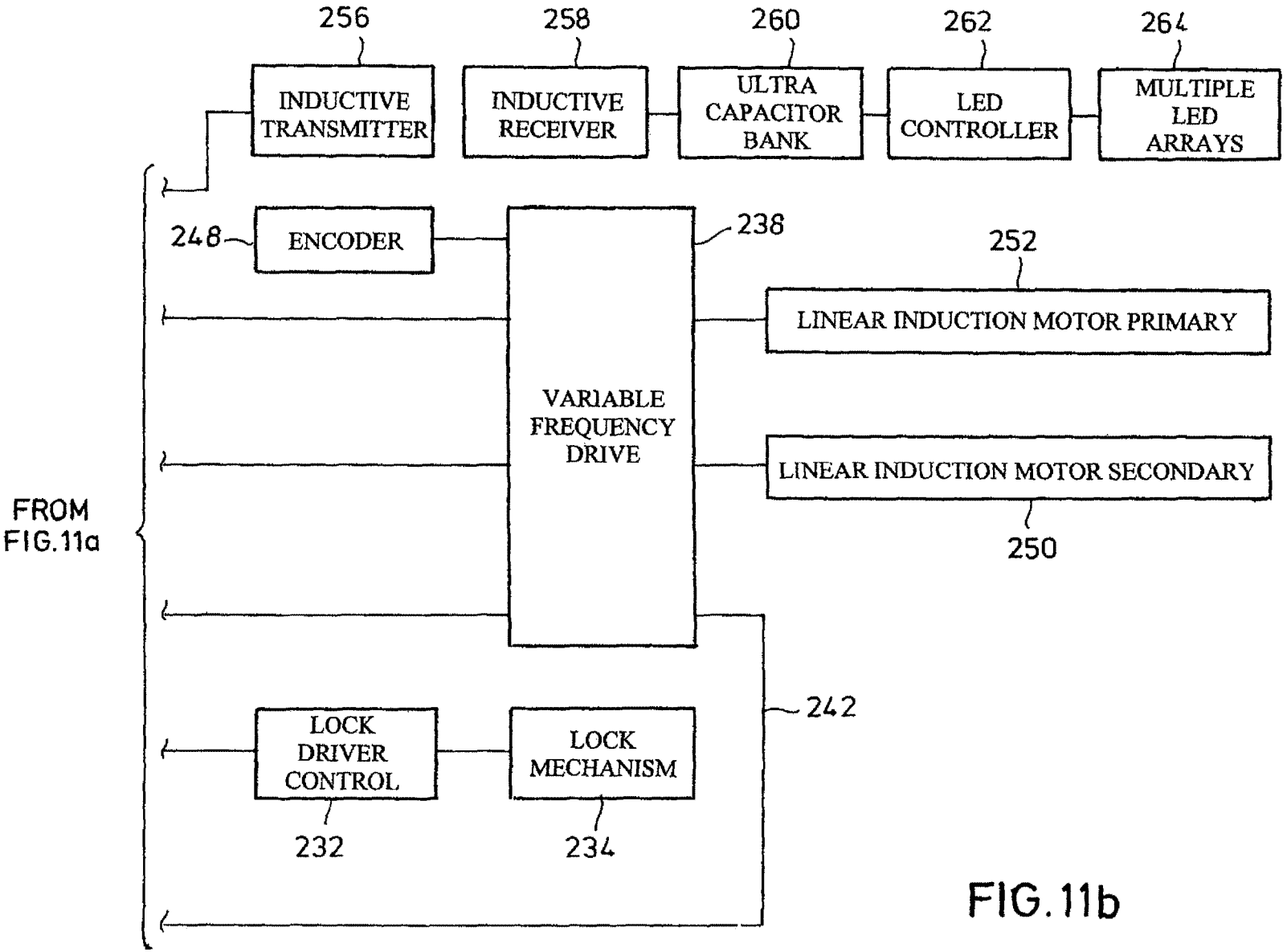

An alternative gate operator control 210 is shown in FIGS. 11*a* and 11*b*. A programmable logic controller 212 (commonly referred to as "PLC") has a main logic control 216 with inputs 214 and outputs 218. The programmable logic controller 212 is basically a computer with inputs 214 and outputs 218 that can be programmed to do different functions. In the present invention, the programmable logic controller 212 is used to open or close a gate or barrier using linear induction motors. The programmable logic controller 212 has a user interface display 220, which connects into the main logic control 216. The user interface display 220 has a liquid crystal display screen that is touch-sensitive so that a user can set parameters the way the user would like to operate the gate or barrier. Such parameters as speed and direction of movement of the gate or barrier are set in through the user interface display 220. Those parameters are fed through the user interface display 220 to the main logic control 216 of the programmable logic controller 212.

Electronic position sensors 222 feeds information through electronic position sensor software 224 of inputs 214 and to the main logic control 216. The electronic position sensors 222 can be the same as electronic sensors 24 describing in conjunction with FIGS. 1 and 2, or it could be any other type of position sensor. What is important is the electronic position sensors 222 give an accurate indication as to the position of the gate or barrier. In the alternative embodiment, the electronic position sensors 222 sense holes 20 in reaction fin 14 as reaction fin 14 moves past either electronic sensors 24 or electronic position sensors 222 (See FIGS. 1, 2, 5, and 7). The electronic position sensor software 224 is a program that is written to look at the output of the electronic position sensors 222 to determine what is being counted, how many have been counted, how fast the counts are occurring, and feeding the information to the main logic control 216. This indicates where the gate or barrier is located. The main logic control 216 then operates the motor control software 246, which is an output 218 fed to the variable frequency drive 238. The variable frequency drive 238 as programmed by encoder 248 will drive the linear induction motor primary 252 and the linear induction motor secondary 250. The linear induction motor primary 252 and linear induction motor secondary 250 controls the direction and the speed of the gate or barrier being opened or closed.

Many other inputs can be fed into the programmable logic controller 212 through device inputs 226. An example may be the temperature of the air in which the barrier or gate is operated. Device input software 228 will process a signal from the device inputs 226 into a form that can be used by the main logic control 216. Another example of a device input 226 may be a card reader that individuals can use to open or close the gate or barrier. There could be a multitude of different device inputs 226 depending upon the desires of the operator.

Assuming a device input 226 indicates the environment is very cold and freezing, main logic control 216 may activate heater controlled software 244, which could hold the barrier or gate in position while operating the variable frequency drive 238 through the linear induction motor primary 252 and linear induction motor secondary 250. This will cause current to flow in the reaction fin (See FIGS. 4, 5, and 6) which would melt any snow or ice thereon.

If the gate or barrier is to be locked in position, it can be determined any number of ways including user interface display 220. The main logic control 216 may operate lock control software 230 which will operate lock driver control 232 (normally a solenoid) to operate lock mechanism 234.

The main logic control 216 operates drive status software 236, which connects through the variable frequency drive 238. If the variable frequency drive 238 is operating properly, feedback 242 connects back to drive healthy software 240 to one of the inputs 214. If the system is not operating properly, drive healthy software 240 will cause the operator control 210 through the main logic control 216 and programmable logic controller 212 to shut down.

The motor control software 246 operates the variable frequency drive 238 to control the speed at which the linear induction motor primary 252 and linear induction motor secondary 250 open or close the gate or barrier. In opening, the movement will start very slow, speed up during the opening, and then slow down as it reaches the open position. This is controlled by the motor control software 246.

The encoder 248 provides a backup system for the variable frequency drive 238 so that if the drive status software 236 gives incorrect information, the encoder 248 can override the drive status software 236. The encoder 248 may have a drive wheel riding on the induction fin 14 to determine the position of the gate or barrier 16.

From the input provided by the electronic position sensors 222 through the electronic position sensors software 224 through the main logic control 216, a closed limit output 254 can be determined. If the barrier 16 is closed, close limit output 254 will send a signal to inductive transmitter 256. Inductive transmitter 256 is stationary and mounted on a stationary object such as post 16*a*, immediately adjacent to the barrier 16. Carried on barrier 16 is an inductive receiver 258 so that when adjacent to inductive transmitter 256 will generate a current to charge ultra capacitor bank 260. There is a small space separating inductive transmitter 256 from inductive receiver 258. After the ultra capacitor bank 260 is charged, an LED controller 262 will provide current to multiple LED arrays 264 to light up the barrier 16. Because of the low current drain of LEDs, the ultra capacitor bank 260 through LED controller 262 can maintain the multiple LED arrays 264 in the lit condition for some period of time before the ultra capacitor bank 260 is discharged. This allows oncoming traffic to see the barrier at night or in adverse weather conditions without having a physical electrical connection with the barrier 16. This is important for high security areas such as military installations.

Although the invention has been described with reference to specific embodiments, this description is not meant to be construed in a limited sense. Various modifications of the disclosed embodiments, as well as alternative embodiments of the invention will become apparent to persons skilled in the art upon the reference to the description of the invention. It is therefore contemplated that the appended claims will cover such modifications that fall within the scope of the invention.

We claim:

1. A system for moving a barrier that controls access through an entry way, said system comprising:

a reaction fin attached to said barrier, said reaction fin having protrusions on each side thereof extending a length of said reaction fin and a plurality of apertures linearly extending said length of said reaction fin, said protrusions and said apertures being in parallel relation on said reaction fin;

a stationary part of a linear induction motor connected to a power source and comprising a plurality of electromagnetic coils in magnetic communication with said reaction fin to accelerate, move, decelerate, stop, and reverse said reaction fin, said linear induction motor by applying a current to said electromagnetic coils generates a magnetic field to move said reaction fin, thereby moving said barrier, said linear induction motor being secured in a position adjacent said barrier;

guide members adjacent said protrusions for directing said reaction fin through said linear induction motor during movement there between;

a variable frequency drive communicating with said linear induction motor to apply and vary said electrical magnetic field;

a locking mechanism attached to said linear induction motor and disposed along said length of said reaction fin;

a main logic control in communication with said variable frequency drive of said linear induction motor, electrical position sensors and said lock driver control;

a user interface connected to said main logic control;

a motor control software operated by said main logic control to communicate with said variable frequency drive to control said linear induction motor;

an inductive transmitter attached to said stationary part of said linear induction motor;

an inductive receiver on said barrier that is inductively coupled with said inductive transmitter when said barrier is closed;

a storage device on said barrier connected to said inductive receiver for charging when said barrier is closed; and low current warning devices on said barrier and connected to said storage device indicating a position of said barrier when opened, closed or in between an open and closed position.

2. The system for moving a barrier that controls access to an entry way as recited in claim 1 wherein said low current warning devices are LED's mounted on, and moving with, said barrier.

3. The system for moving a barrier that controls access to an entry way as recited in claim 2 wherein said locking mechanism will hold said barrier while said linear induction motor is cycled during cold weather to melt any ice on said reaction fin.

4. The system for moving a barrier as recited in claim 3 wherein said reaction fin further comprises a first plate attached to a second plate, said first plate having an end portion offset to a corresponding end portion of said second plate;

wherein said first plate and said second plate are substantially mirror images of one another; and wherein said plurality of apertures in said reaction fin are substantially aligned from said first plate to said second plate.

5. The system for moving a barrier as recited in claim 4 wherein each of said apertures are substantially equal in dimension and substantially equally spaced from adjacent said apertures.

6. The system for moving a barrier as recited in claim 5 wherein said electronic position sensors senses are disposed along said reaction fin and aligned to sense said plurality of apertures in said reaction fin to determine the position, speed and direction of said reaction fin during movement.

7. The system for moving a barrier as recited in claim 6 wherein said guide member and said protrusion are on each side of said reaction fin.

8. The system for moving a barrier as recited in claim 7 further comprising an electronic sensor software operated by said main logic control to communicate with said electronic position sensors to determine the speed, position and direction of said reaction fn.

9. The system for moving a barrier as recited in claim 8 further compromising a locking mechanism software operated by said logic control to communicate with said locking mechanism to operate said locking mechanism.

* * * * *